US007337930B2

(12) United States Patent
Ophardt et al.

(10) Patent No.: US 7,337,930 B2
(45) Date of Patent: Mar. 4, 2008

(54) FOAMING PUMP WITH IMPROVED AIR INLET VALVE

(75) Inventors: Heiner Ophardt, Vineland (CA); Andrew Jones, St. Catharines (CA)

(73) Assignee: Gotohti.com Inc., Beamsville, Ontario (CA)

( * ) Notice: Subject to any disclaimer, the term of this patent is extended or adjusted under 35 U.S.C. 154(b) by 448 days.

(21) Appl. No.: 11/133,176

(22) Filed: May 20, 2005

(65) Prior Publication Data

US 2006/0261083 A1 Nov. 23, 2006

(51) Int. Cl.
*F04B 33/00* (2006.01)

(52) U.S. Cl. ..... 222/628; 222/190

(58) Field of Classification Search ..... 623/23.5, 623/23.24, 23.22, 23.21, 23.18, 23.25, 23.23, 623/23.44, 22.42, 20.15; 222/618, 190, 321.7–321.9, 222/189.1, 372, 383.1, 373, 375
See application file for complete search history.

(56) References Cited

U.S. PATENT DOCUMENTS

| | | | | |
|---|---|---|---|---|
| 3,627,206 | A | 12/1971 | Boris | |
| 3,752,370 | A | 8/1973 | Davenport | |
| 4,402,432 | A | 9/1983 | Corsette | |
| 4,511,065 | A | 4/1985 | Corsette | |
| 4,957,218 | A | 9/1990 | Ford | |
| 5,163,588 | A | 11/1992 | Cater | |
| 5,207,785 | A | 5/1993 | Knickerbocker | |
| 5,271,530 | A | 12/1993 | Uehira et al. | |
| 5,348,189 | A | 9/1994 | Cater | |
| 5,431,309 | A | 7/1995 | Ophardt | |
| 5,445,288 | A | 8/1995 | Banks | |
| 5,570,819 | A * | 11/1996 | Uehira et al. | 222/190 |
| 5,676,277 | A | 10/1997 | Ophardt | |
| 5,813,571 | A | 9/1998 | Gaucher | |
| 5,839,617 | A | 11/1998 | Cater et al. | |
| 5,899,363 | A | 5/1999 | Bliss, III | |
| 6,065,647 | A | 5/2000 | Bliss, III | |
| 6,082,586 | A | 7/2000 | Banks | |
| 6,206,245 | B1 | 3/2001 | Bonningue | |
| 6,209,761 | B1 | 4/2001 | Bonningue | |
| 6,334,549 | B1 | 1/2002 | Fernandez | |
| 6,409,050 | B1 | 6/2002 | Ophardt | |
| 6,446,840 | B2 | 9/2002 | Ophardt | |
| 6,601,736 | B2 | 8/2003 | Ophardt et al. | |
| 6,763,978 | B2 | 7/2004 | Pritchett et al. | |
| 6,814,263 | B2 | 11/2004 | Rosenthal | |
| 6,923,346 | B2 * | 8/2005 | Foster et al. | 222/190 |
| 7,004,356 | B1 * | 2/2006 | Sayers | 222/137 |
| 7,147,133 | B2 * | 12/2006 | Brouwer et al. | 222/145.5 |
| 2002/0070238 | A1 * | 6/2002 | Pritchett et al. | 222/189.11 |

(Continued)

*Primary Examiner*—Lien M. Ngo
(74) *Attorney, Agent, or Firm*—Riches, McKenzie & Herbert LLP

(57) ABSTRACT

A piston pump for dispensing foam by simultaneously dispensing air and liquid through a foam generator and in which air to be dispensed is drawn into a chamber from which it is to be dispensed, at least in part, through an air inlet passageway which is different than a flow path out which foam is dispensed. A lost link valve arrangement provides for relative motion to open the air inlet passageway when air is drawn into the chamber and to close the air inlet passageway when air is forced out of the chamber to a dispensing outlet. Preferably, the lost link valve arrangement is provided by a piston carrying an actuator member coaxially slidable thereon to selectively open and close the air inlet passageway.

20 Claims, 6 Drawing Sheets

U.S. PATENT DOCUMENTS

2004/0149777 A1* 8/2004 Santagiuliana ..... 222/190
2004/0217133 A1 11/2004 Ramet
2004/0251280 A1 12/2004 Crosnier

* cited by examiner

FOAMING PUMP WITH IMPROVED AIR INLET VALVE

SCOPE OF THE INVENTION

This invention relates to foaming pumps and, more particularly, to providing in a foaming pump an air inlet valve for admission of air to an air chamber which is activated by movement of a piston and, preferably, mechanically activated.

BACKGROUND OF THE INVENTION

Foaming pumps are known as taught by U.S. Pat. No. 5,271,530 to Uehira et al; U.S. Pat. No. 5,445,288 to Banks; U.S. Pat. No. 6,409,050 to Ophardt and U.S. Pat. No. 6,446,840 to Ophardt. Different of these pumps suffer from various disadvantages that air needs to be drawn back into an air chamber through an elongate dispensing tube, the air is limited to being drawn back through a foam generator and that air is drawn back through an air inlet valve which does not lend itself to ease of manufacture.

SUMMARY OF THE INVENTION

To at least partially overcome these disadvantages of the previously known devices, the present invention provides an air inlet valve for admission of air to an air chamber which mechanically opens when the piston is moved outwardly and closes when the piston is moved inwardly.

An object of this invention is to provide an improved air inlet valve arrangement for admission of air to an air chamber in a foaming pump.

Another object is to provide a construction for a foaming pump.

In one aspect, the present invention provides a piston pump for dispensing foam by simultaneously dispensing air and liquid through a foam generator and in which air to be dispensed is drawn into a chamber from which it is to be dispensed, at least in part, through an air inlet passageway which is different than a flow path out which foam is dispensed. A lost link valve arrangement provides for relative motion to open the air inlet passageway when air is drawn into the chamber and to close the air inlet passageway when air is forced out of the chamber to a dispensing outlet. Preferably, the lost link valve arrangement is provided by a piston carrying an actuator member coaxially slidable thereon to selectively open and close the air inlet passageway.

In one aspect, the present invention provides a foaming pump having:

a piston reciprocally slidable in a piston chamber forming element in which:

(a) in the piston retracting in a retracting stroke to simultaneously force air from an air chamber and liquid from a liquid chamber internally through a central bore of the piston and through a foam generator to produce foam and deliver foam from a dispensing outlet carried on the piston, and (b) in the piston extending in an extension stroke to simultaneously draw air into the air chamber and liquid into the liquid chamber, an air inlet passageway for providing communication between external air and the air chamber, a valve across the air inlet passageway to open and close the air inlet passageway, the valve coupled to the piston to mechanically be moved to a closed position when the piston is retracting in a retraction stroke and to assume an open position when the piston is extending in an extension stroke.

BRIEF DESCRIPTION OF THE DRAWINGS

Further aspects and advantages of the present invention will occur from the following description taken together with the accompanying drawings in which.

DETAILED DESCRIPTION OF THE DRAWINGS

Figure 1:
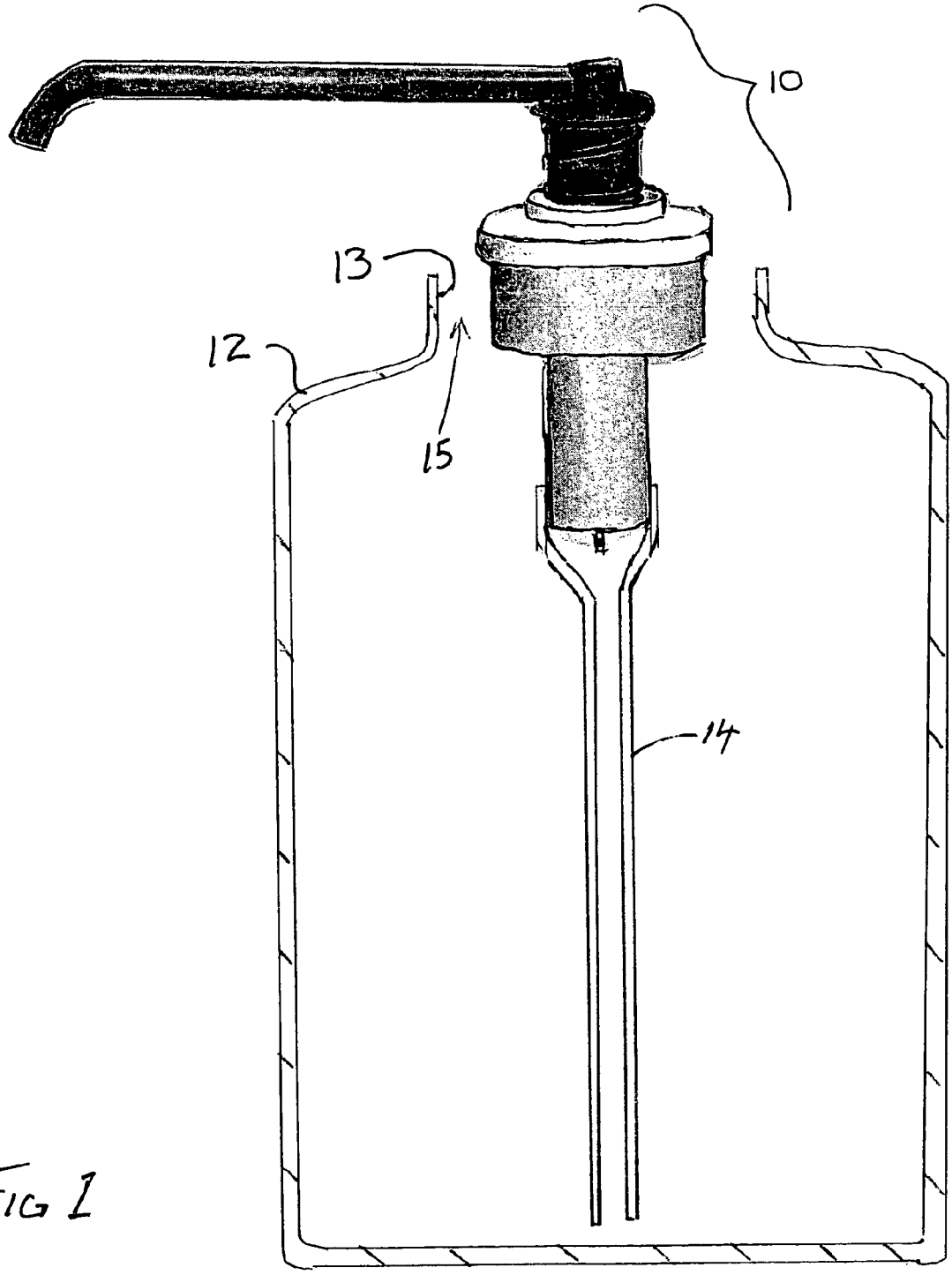
FIG. 1 is a perspective view of a first embodiment of a pump in accordance with the present invention at rest and schematically shown in the mouth of a bottle with a dip tube also shown in cross-section to extend downwardly into the bottle.

Referring to FIG. 1, a pump assembly 10 is shown received in the mouth 13 of a bottle 12 with a dip tube 14 extending down from the pump assembly into the bottle 12. Air may enter the bottle 12 through gaps 15 between the pump assembly 10 and the mouth 13 of the bottle which is not sealed.

The pump assembly 10 comprises:

a piston chamber forming member 16, a piston assembly 18, and a chamber lid 21.

The piston chamber forming member 16 is generally disposed about a central axis 17 and has a cylindrical inner liquid chamber 92 which opens outwardly into a cylindrical outer air chamber 94 of larger diameter. The liquid chamber 92 has at its lower end a liquid inlet 93 with a one-way inlet valve 96 which provides for fluid flow outwardly from the bottle into the chamber but prevents fluid flow inwardly.

The piston assembly 18 comprises:

a piston body 19, and a piston slide actuator 20.

The piston body 19 has:

a nose portion 40, a tail portion 42, a foam generator 44, and an annular seal member 45.

The nose portion 40 and the tail portion 42 are fixedly secured together sandwiching the foam generator 44 and annular seal member 45 therebetween to form the piston body 19 as an integral unit.

The piston slide actuator 20 is coupled to the piston body 19 for limited sliding movement relative the piston body 19 between an expanded position and a compressed position. The slide actuator 20 includes a sleeve portion 22 coaxially about an outer end 24 of the piston body 19. An outlet tube 26 secured to the sleeve portion 22 and extends radially outwardly from the sleeve portion 22. The sleeve portion 22 has a central bore 28 therethrough open at an inner end and closed at an outer end 29 where it opens radially into a bore 32 through the outlet tube 26 leading to a tube outlet 27 from which foamed liquid is to be dispensed. The central bore 28 of the sleeve portion 22 is in communication with a central passageway 34 through a stem 38 of the piston body 19.

The sleeve portion 22 is coaxially disposed about the outer end 24 of the stem 38 of the piston body 19 and adapted to slide coaxially relative to the piston body 19.

The outer end 24 of the stem 38 has an outermost portion with a cylindrical exterior surface 50. The exterior surface 50 ends at its inward end at a reduced diameter cylindrical groove 54 with an inwardly directed stop shoulder 52 therebetween. The groove 54 ends at an inner extent at a frustoconical surface 55 which enlarges in diameter inwardly.

The sleeve portion 22 has, in its central bore 28, an outer bore portion with a cylindrical interior surface 58 which is complementary to the diameter of the exterior surface 50 of the outer end 24 of the stem 38. The cylindrical interior surface 58 ends at its inner end at an annular ring 60 having a reduced diameter interior surface 62 with an outwardly directed stop shoulder 61 therebetween. The cylindrical interior surface 62 of the ring 60 which is complementary to the diameter of the groove 54 and ends at an inner end with a frustoconical end surface 64 which is complementary to the frustoconical surface 55 of the stem 38.

Figure 3:
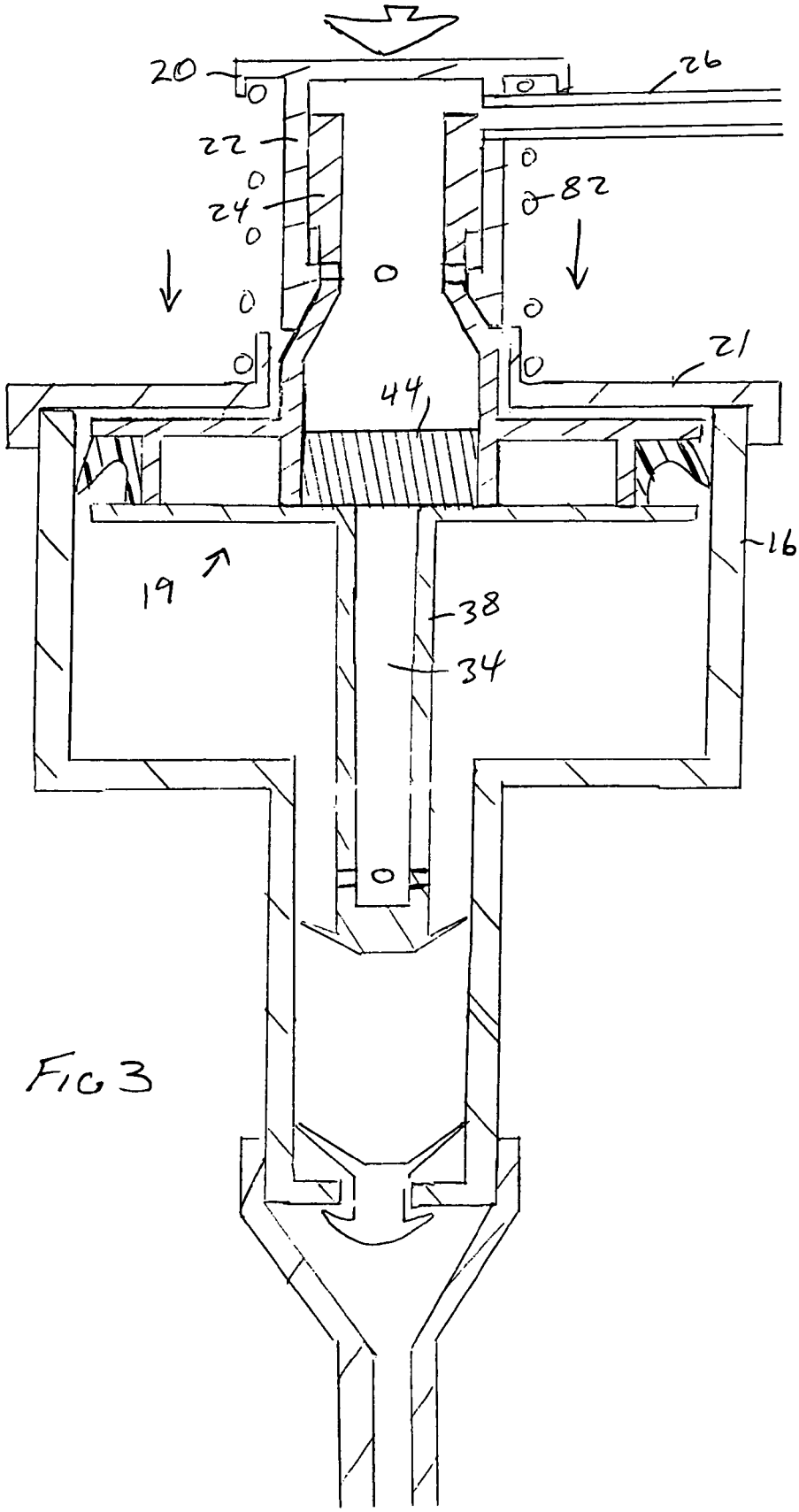
FIG. 3 is a cross-sectional view of the pump of FIG. 2 with the piston slide actuator in a compressed position and the piston body in the extended position.
Figure 4:
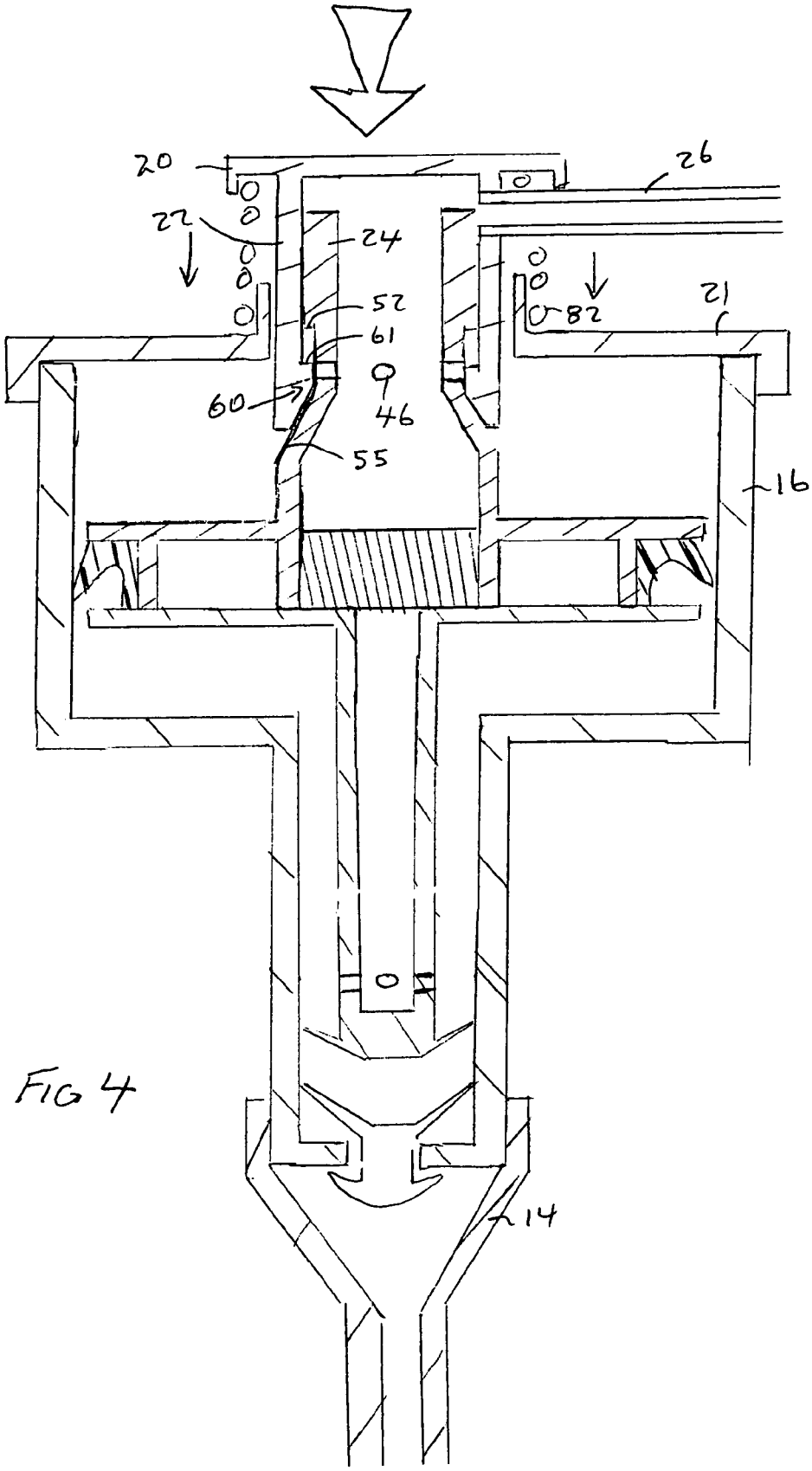
FIG. 4 is a cross-sectional view of the pump of FIG. 2 with the piston slide actuator in a compressed position and the piston body in the extended position.

The groove 54 has a greater axial extent than the ring 60 such that the piston slide actuator 20 and its slide sleeve portion 22 with its ring 60 may be moved relative to the piston body 19 between:

(1) an expanded position with the stop shoulder 62 of the ring 60 engaged on the stop shoulder 52 of the groove 54, and (2) a compressed position with the frustoconical surface 64 of the ring 60 engaged on the frustoconical surface 55 of the piston body 19 as seen in FIGS. 3 and 4.

Figure 2:
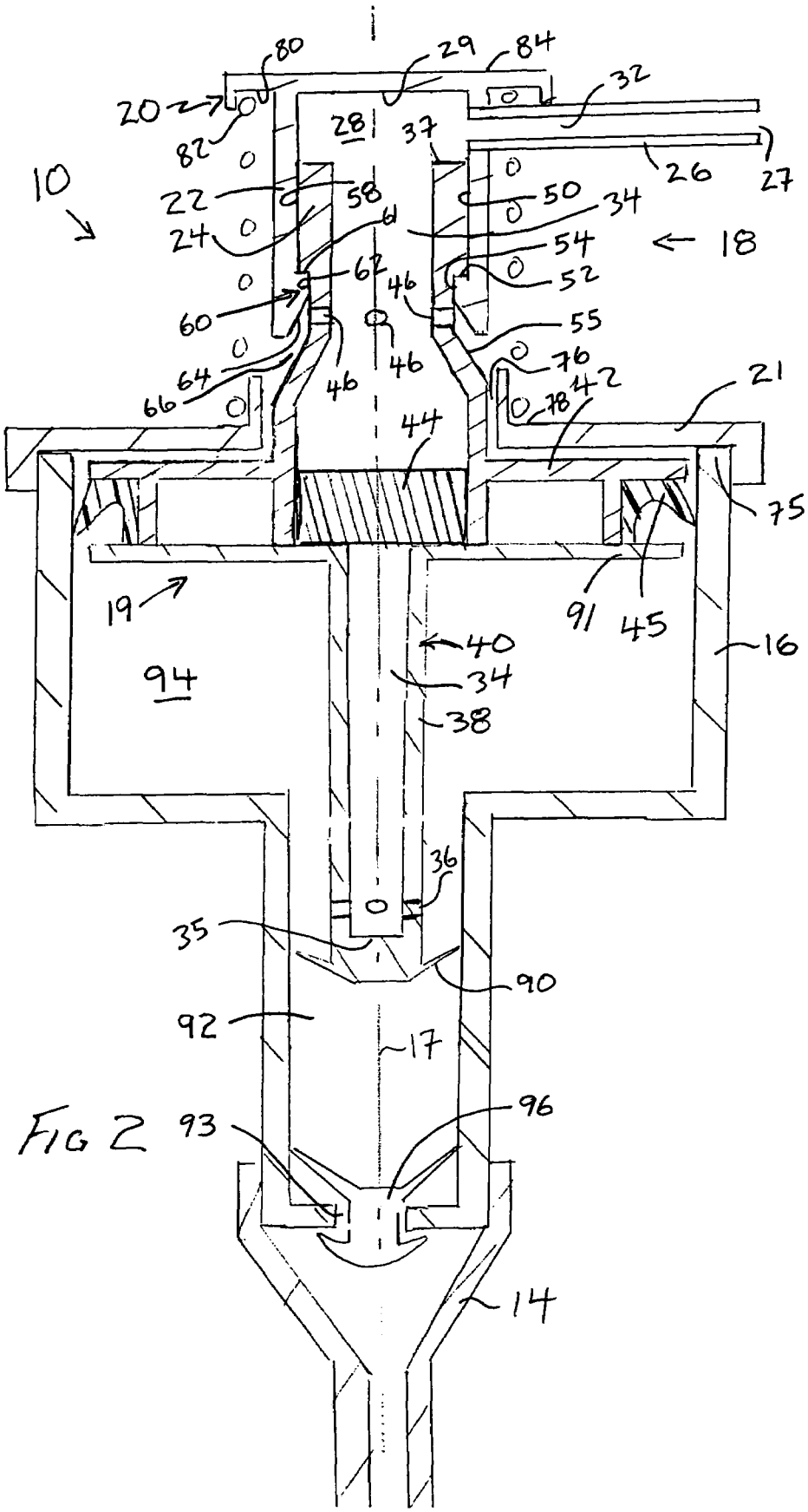
FIG. 2 is a cross-sectional view of the pump of FIG. 1 at rest with the piston slide actuator in an expanded position and piston body in the extended position.

Air inlet ports 46 are provided in the groove 54 extending through the side wall of the stem 38 into communication with a central passageway 34 inside the stem 38. When the piston slide actuator 20 is in the expanded position relative the piston body 19 as seen in FIG. 2, the air inlet ports 46 are open to outside air via a passage 66 between the inner end of the ring 60 and the exterior surface of the piston body 19. When the piston slide actuator 20 is in the compressed position relative the piston body 19, as seen in FIGS. 3 and 4, then the air inlet ports 46 are closed to outside air by the frustoconical end surfaces 64 of the ring 60 engaging the frustoconical side wall of the stem 38 on an inner side of the air inlet ports 46.

As shown in FIGS. 1 and 2, a lid 21 is engaged about an outer end 75 of the piston chamber forming member 16 with a central opening 76 through the lid 21 for passage of the piston assembly 18. The lid 21 provides an annular surface 78 about the piston assembly 18 directed outwardly in opposition to an annular surface 80 directed inwardly on the slide actuator 20. A helical spring 82 is disposed between the annular surface 78 on the lid 21 and the annular surface 80 on the slide actuator 20 urging the slide actuator 20 to assume the expanded position relative the piston body 19 and thereby urging the piston body 19 to assume an extended position relative the piston chamber forming member 16.

Figure 5:
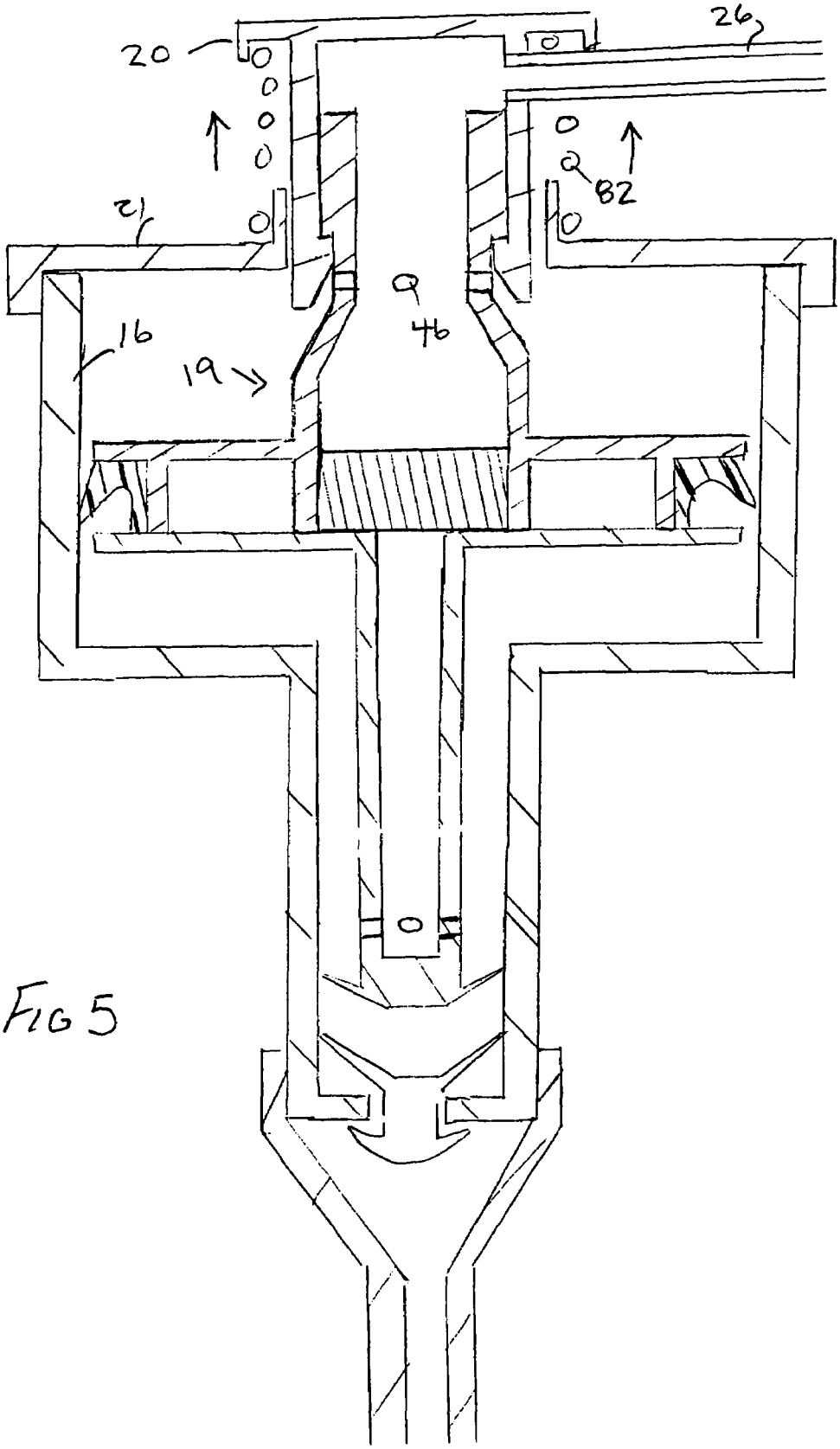
FIG. 5 is a cross-sectional view of the pump of FIG. 2 with the piston slide actuator in a compressed position and the piston body in the extended position.

When in the rest position as shown in FIG. 2, on applying axially directed forces onto the slide actuator 20, as by a user manually applying axially directed forces to a top surface 84 of the slide actuator 20, the slide actuator 20 moves from its expanded position to its compressed position relative to the piston body 19, with the piston body 19 not moving so as to assume the configuration shown in FIG. 3. On the slide actuator 20 reaching the compressed position, further inward movement of the slide actuator 20 moves the piston body 19 inwardly from the extended position shown in FIG. 3 towards a retracted position of the piston body 19 relative the piston chamber forming member 16 as seen in FIG. 4. Thus, it follows that in a compression stroke of the piston assembly 18, when the piston body 19 is moved inwardly by forces applied to the slide actuator 20, the air inlet ports 46 are closed and air from the air chamber 94 and liquid from the liquid chamber 92 are simultaneously urged through outlet ports 36 into a central passageway 34 of the stem 38, through the foam generator 44 and, subsequently, out the outlet tube 26 to exit its outlet 27. In a return stroke, as in moving from the configuration of FIG. 4 to the configuration of FIG. 5 on release of external forces onto the slide actuator 20, the spring 82 moves the slide actuator 20 outwardly, the slide actuator 20 draws the piston body 19 outwardly and the air inlet ports 46 are open such that air may be drawn inwardly via the air inlet ports 46 through the foam generator 44, central passageway 34 and outlet port 36 into the air chamber 94 while liquid is drawn through the liquid inlet valve 96 into the liquid chamber 92. With the air inlet ports 46 open, air to fill the air chamber 94 need not be drawn back through the outlet tube 26.

The piston body 19 includes a central stem 38 which carries an inner liquid disc 90 and an outer air disc 91. The liquid disc 90 extends radially outwardly from the stem 38 within the liquid chamber 92 and has a flexible outer periphery which engages the interior walls of the fluid chamber 92 to prevent flow of fluid inwardly past the liquid discs 90 but deflects radially inwardly to permit fluid flow outwardly from the bottle into the liquid chamber 92.

The air disc 91 carries annular seal member 45 which engages the interior walls of the air chamber 94 to form a seal and prevent air flow therepast at least outwardly.

The stem 38 has a hollow central passageway 34 closed at an inner blind end 35 and open at an inner end 37. An inlet port 36 is provided radially through the wall of the stem 38 between the inner liquid disc 90 and the outer air disc 91 to provide communication into the passageway 34. The foam generator 44 is disposed within the central passageway 34 outwardly of the inlet port 36.

Figure 6:
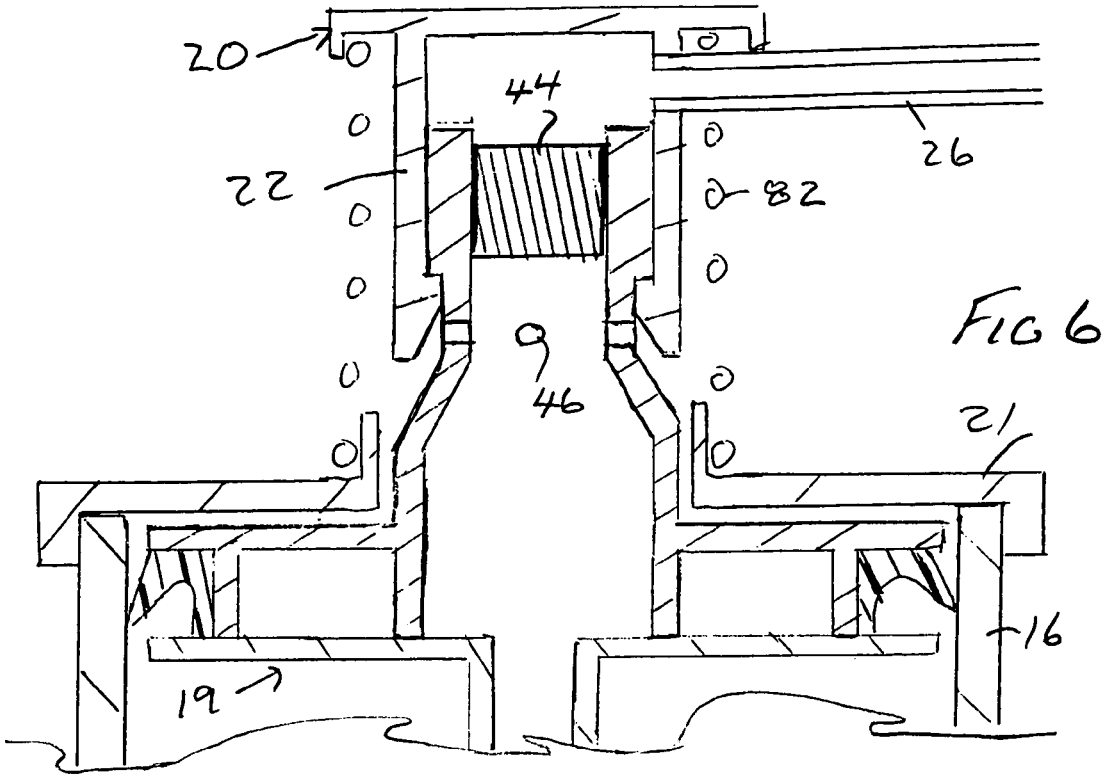
FIG. 6 is a cross-sectional side view similar to that of FIG. 2 but of a second embodiment of a pump in accordance with the present invention.

Reference is made to FIG. 6 which shows a cross-sectional side view similar to FIG. 2, however, of a second embodiment substantially the same as the first embodiment, however, with the foam generator 44 located outwardly from the air inlet ports 46. In the embodiment of FIG. 6, air which is drawn in through the air inlet ports 46 need not pass through the foam generator 44.

Figure 7:
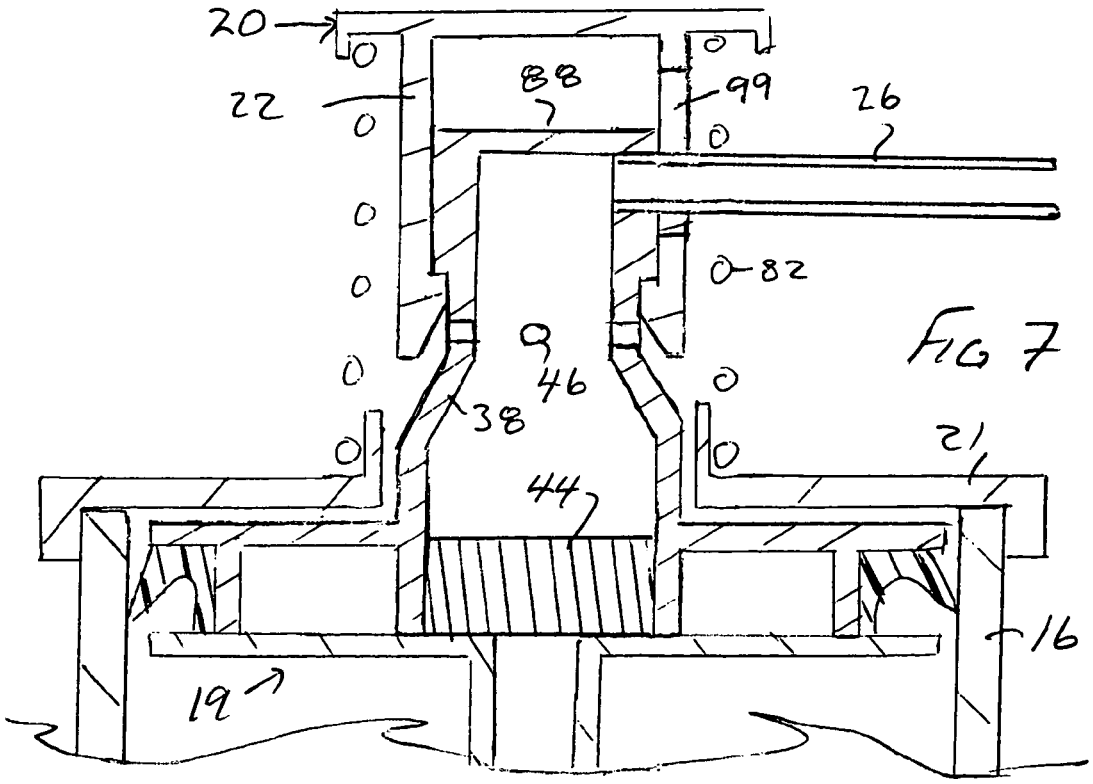
FIG. 7 is a cross-sectional view similar to FIG. 2 but of a third embodiment of a pump in accordance with the present invention.

Reference is made to FIG. 7 which is similar to FIG. 2, however, shows a third embodiment in which the outlet tube 26 is connected directly to the stem 38 of the piston body 19 with the stem 38 having a blind end 88. As shown, the slide sleeve 22 of the slide actuator 20 is modified so as to have a slot 99 in one side thereof of sufficient axial length to prevent interference with the outlet tube 26 yet permit the slide actuator 20 to slide axially relative to the piston body 19.

The embodiments illustrated in FIGS. 1 to 7 each utilize a lost link motion whereby movement of the slide sleeve 22 relative the piston body 19 opens and closes the air inlet ports 46.

Other mechanical linkings may be provided for opening and closing of the air inlet ports 46. For example, downward movement of a sleeve and a piston body could provide for relative rotation of a slide sleeve relative to the piston body with such relative rotation of a sleeve opening and closing air inlet ports. For example, a camming pin or surface on the lid could engage a cam surface or pin on a sleeve which is rotationally mounted on the pump body and cause rotation of the sleeve relative to the piston body on axial movement of the piston body and/or the sleeve relative the lid.

Additionally, a mechanical valve arrangement could be provided to open and close the air inlet ports as in the manner of an O-ring trapped in an annular groove and capable of moving either to an inner or outer side of an inlet port as in the manner of the valve mechanism indicated by reference numerals 10, 11 and 12 in FIG. 1 of U.S. Pat. No. 6,446,840.

While the invention has been described with reference to preferred embodiments, many modifications and variations will now occur to a person skilled in the art. For a definition of the invention, reference is made to the following claims.

We claim:

1. A foaming pump having:

a piston reciprocally slidable in a piston chamber forming element in which:

(a) in the piston retracting in a retracting stroke to simultaneously force air from an air chamber and liquid from a liquid chamber internally through a central bore of the piston and through a foam generator to produce foam and deliver foam from a dispensing outlet carried on the piston, and (b) in the piston extending in an extension stroke to simultaneously draw air into the air chamber and liquid into the liquid chamber, an air inlet passageway for providing communication between external air and the air chamber, a valve across the air inlet passageway to open and close the air inlet passageway, the valve coupled to the piston to mechanically be moved to a closed position when the piston is retracting in a retraction stroke and to assume an open position when the piston is extending in an extension stroke.

2. A pump as claimed in claim 1 wherein the foam on passing through the foam generator is moved through a discharge passageway to the dispensing outlet, the air inlet passageway being located intermediate the foam generator and the dispensing outlet.

3. A pump as claimed in claim 1 wherein the air inlet passageway is in communication with the air chamber inwardly of the foam generator.

4. A pump as claimed in claim 1 wherein a lost motion slide member is coupled to an outlet end of the piston for coaxial sliding relative the piston between an expanded and a compressed position without movement of the piston, in an expanded position of the slide member relative the piston, the air inlet passageway being open and in a compressed position of the slide member relative the piston, the air inlet passageway is closed, in the expanded position of the slide member further outward movement of the slide member moves the piston outwardly, and in the compressed position of the slide member further inward movement of the slide member moves the piston inwardly.

5. A pump as claimed in claim 4, including a biasing member biasing the slide member to its expanded position and thereby indirectly biasing the piston to its extended position.

6. A pump as claimed in claim 5, wherein the biasing member is disposed between the slide member and the piston chamber forming element.

7. A pump as claimed in claim 6 wherein the slide member comprises a manual activator with a surface for manual engagement to apply forces opposed to the bias of the biasing member.

8. A pump as claimed in claim 5 wherein the slide member carrying an outlet delivery tube extending radially of the axis about which the piston and slide member are slidable relative to the piston chamber forming element.

9. A pump as claimed in claim 1 including a sleeve ring carried about the piston circumferentially rotatably journalled thereon for rotation about an axis along which the piston is slidable relative the piston chamber forming element.

10. A pump as claimed in claim 1 wherein a sleeve is coupled to the piston chamber forming element by a camming engagement whereby, as the sleeve moves axially relative the piston chamber forming element, the sleeve rotates about the piston.

11. A pump as claimed in claim 1 in combination with a liquid containing reservoir, the liquid chamber in communication with the reservoir via a liquid inlet, a one-way inlet valve permitting flow inwardly through the liquid inlet.

12. A pump as claimed in claim 1 wherein the liquid chamber is a cylindrical chamber with an inlet, an outlet, a diameter and a chamber wall;

the air chamber is a cylindrical chamber with an inlet, an outlet and a diameter;

the diameter of the air chamber being greater than the diameter of the liquid chamber;

the air chamber disposed above the liquid chamber coaxially disposed thereto with the outlet of the liquid chamber opening upwardly into the inlet of the air chamber, the inlet of the liquid chamber below the outlet of the liquid chamber, the inlet of the liquid chamber in communication with liquid in a reservoir;

a one-way liquid inlet valve permitting flow only inwardly into the liquid chamber through the inlet of the liquid chamber, the piston having an elongate stem carrying a first disc in the liquid chamber engaging the chamber wall of the liquid chamber to prevent fluid flow inwardly therepast yet permitting fluid flow outwardly therepast to the air chamber; and a second disc in the air chamber engaging the chamber wall of the air chamber to prevent fluid flow inwardly or outwardly therepast;

the central bore of the piston provided internally of the stem closed at an inner end and open at an outer end in communication with the dispensing outlet which extends out of the outlet of the air chamber, a first inlet through the stem between the first disc and the second disc providing communication from between the first disc and the second disc to the bore, a second inlet through the stem outwardly of the second disc for providing communication with outside air to the bore, and the air inlet passageway formed by the first inlet, the second inlet and the bore between the second inlet and the first inlet.

13. A pump as claimed in claim 12 wherein the foam generator is disposed in the bore between the first inlet and the second inlet.

14. A pump as claimed in claim 12 wherein the piston includes a slide actuator axially slidably mounted to the stem outwardly of the second disc for sliding axially between a retracted position in which the slide actuator closes the second inlet to flow therethrough and an extended position in which the slide actuator does not close the second inlet.

15. A pump as claimed in claim 14 including a spring disposed between the piston chamber forming element and the slide actuator biasing the slide actuator axially outwardly, the slide actuator slidable on the piston stem between an outer engaged position and an inner engaged position such that the slide actuator is slidable independently of the piston stem between the outer engaged position and the inner engaged position and when in the outer engaged position, outward movement of the actuator member moves the piston outwardly and when in the inner position, inward movement of the slide actuator moves the piston inwardly.

16. A pump as claimed in claim 15 wherein the slide actuator has a channelway therethrough open at an inlet to the outer end of the bore and providing communication between the outer end of the bore and the outlet.

17. A pump as claimed in claim 16 wherein the slide actuator is coaxially disposed about the stem radially outwardly thereof.

18. A pump as claimed in claim 17 wherein the spring is a helical coil spring disposed radially outwardly of the stem of the piston.

19. A pump as claimed in claim 12 wherein the foam generator is disposed in the bore between the second inlet and the outlet.

20. A pump as claimed in claim 12 wherein a dip tube extends downwardly from the inlet to the liquid chamber to provide communication with liquid below the liquid chamber.

* * * * *